US010460898B2

(12) United States Patent
Kim

(10) Patent No.: US 10,460,898 B2
(45) Date of Patent: Oct. 29, 2019

(54) CIRCUIT BREAKERS

(71) Applicant: LSIS CO., LTD., Anyang-si, Gyeonggi-do (KR)

(72) Inventor: Sunkook Kim, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 118 days.

(21) Appl. No.: 15/863,272

(22) Filed: Jan. 5, 2018

(65) Prior Publication Data

US 2018/0277326 A1 Sep. 27, 2018

(30) Foreign Application Priority Data

Mar. 27, 2017 (KR) ..... 10-2017-0038588

(51) Int. Cl.
*H01H 9/00* (2006.01)
*H01H 71/24* (2006.01)

(52) U.S. Cl.
CPC ..... *H01H 71/2472* (2013.01); *H01H 2235/01* (2013.01)

(58) Field of Classification Search
CPC ..... H01H 71/1009; H01H 71/2472; H01H 2235/01; H01H 9/342; H01H 9/345; H01H 1/2058
USPC ..... 335/172
See application file for complete search history.

(56) References Cited

U.S. PATENT DOCUMENTS 8,766,760 B2 7/2014 Weber et al.
2006/0077023 A1* 4/2006 Oh ..... H01H 77/10 335/172
2008/0122563 A1* 5/2008 Song ..... H01H 71/446 335/176
2009/0039988 A1* 2/2009 Song ..... H01H 71/501 335/21
2013/0140275 A1 6/2013 Shae et al.
(Continued)

FOREIGN PATENT DOCUMENTS

CN 1071784 A 5/1993
CN 1758403 A 4/2006
(Continued)

OTHER PUBLICATIONS

Chinese Office Action for related Chinese Application No. 201810171049.1; action dated Mar. 21, 2019; (10 pages).
(Continued)

*Primary Examiner* — Shawki S Ismail
*Assistant Examiner* — Lisa N Homza
(74) *Attorney, Agent, or Firm* — K&L Gates LLP

(57) ABSTRACT

Provided is a circuit breaker including a single pole breaking unit with a pressure trip device that rotates a trip bar through an arc gas and an opening/closing mechanism unit adjusted to be in a trip state as the trip bar rotates through the pressure trip device. The pressure trip device includes: a first case connected to the single pole breaking unit and having an arc gas discharge hole; a barrier positioned in the front of the arc gas discharge hole and bent through an arc gas discharged through the arc gas discharge hole; a shooter seated on the first case and configured to drive the trip bar while moving through the arc gas discharged through the arc gas discharge hole; and a second case connected to cover the first case.

7 Claims, 12 Drawing Sheets

(56) References Cited

U.S. PATENT DOCUMENTS

| | | | | |
|---|---|---|---|---|
| 2015/0077211 | A1* | 3/2015 | Baek | H01H 71/164 337/112 |
| 2015/0179360 | A1* | 6/2015 | Lee | H01H 3/28 335/38 |
| 2016/0268085 | A1* | 9/2016 | Oh | H01H 71/025 |
| 2017/0236671 | A1* | 8/2017 | Seo | H01H 71/04 200/308 |
| 2017/0243710 | A1* | 8/2017 | Oh | H01H 71/025 |
| 2018/0277316 | A1* | 9/2018 | Lee | H01H 1/2058 |
| 2018/0277326 | A1* | 9/2018 | Kim | H01H 1/2058 |

FOREIGN PATENT DOCUMENTS

| | | | |
|---|---|---|---|
| CN | 103021750 | A | 4/2013 |
| DE | 102009010227 | A1 | 8/2010 |
| EP | 0455564 | A1 | 11/1991 |
| EP | 0991094 | A1 | 4/2000 |
| FR | 2682530 | A1 | 4/1993 |
| JP | 2000100308 | A | 4/2000 |
| KR | 100574423 | | 4/2006 |
| KR | 100574423 | B1 | 4/2006 |
| KR | 20060030971 | A | 4/2006 |
| KR | 1020060030972 | | 4/2006 |
| KR | 1020060030973 | | 4/2006 |
| KR | 100616086 | | 8/2006 |
| KR | 100616086 | B1 | 8/2006 |
| KR | 100662887 | | 12/2006 |
| KR | 100662887 | B1 | 12/2006 |
| KR | 20080034605 | | 4/2008 |
| KR | 20090016345 | A | 2/2009 |
| KR | 100914204 | B1 | 8/2009 |
| KR | 101027780 | B1 | 4/2011 |

OTHER PUBLICATIONS

European Search Report for related European Application No. 17210195.8; action dated Jun. 20, 2018; (8 pages).

Korean Office Action for related Korean Application No. 10-2017-0038588; action dated Feb. 19, 2018; (5 pages).

* cited by examiner

CIRCUIT BREAKERS

CROSS-REFERENCE TO RELATED APPLICATION

Pursuant to 35 U.S.C. § 119(a), this application claims the benefit of earlier filing date and right of priority to Korean Application No. 10-2017-0038588, filed on Mar. 27, 2017, the contents of which is incorporated by reference herein in its entirety.

BACKGROUND OF THE INVENTION

1. Field of the Invention

The present invention relates to a circuit breaker, and more particularly, to a circuit breaker for configuring a pressure trip device, which is included in a single pole breaking unit, in a module form to improve the assemblability of the single pole breaking unit and the reliability of operations.

2. Background of the Invention

In general, a circuit breaker is an electronic device that is installed on an electric line and protects a load device by breaking a circuit when an overload or short-circuit accident occurs, and of course, prevents a fire due to an overload or short-circuit accident and protects people's lives.

In addition, such a circuit breaker has a structure in which an extinction device, an opening/closing mechanism unit, and a detection mechanism unit are integrated into an enclosure that is an insulating body, and allows a user to manually manipulate a handle exposed to the outside of the enclosure to control an electric line to be in a closed state or an open state.

FIG. 1 is a perspective view showing a circuit breaker including a conventional single pole breaking unit. FIG. 2 is a partially enlarged view of a pressure trip device in a conventional single pole breaking unit. FIG. 3 is a side view showing an exhaust hole of a pressure trip device in a conventional single pole breaking unit. FIG. 4 is a side view showing a state before a shooter moves upward through a pressure trip device in a conventional single pole breaking unit. FIG. 5 is a side view showing a state in which a shooter moves upward through a pressure trip device in a conventional single pole breaking unit to move a trip bar. FIG. 6 is a perspective view showing a state in which a single pole breaking unit is separated from a conventional three-phase circuit breaker. FIG. 7 is a plan view showing a state in which a single pole breaking unit is coupled to a conventional three-phase circuit breaker.

As shown in FIGS. 1 to 7, a conventional circuit breaker 10 includes a handle 11*a* for controlling the ON or OFF state of the circuit breaker 10, an opening/closing mechanism unit 11 having a trip bar 11*b*, a detection mechanism unit (not shown) for detecting an abnormal current on an electric line, and a single pole breaking unit 13.

At this time, the single pole breaking unit 13 includes a movable contact (not shown), a fixed contact (not shown) and an extinction unit (not shown). When a fault current is applied to the circuit breaker 10, the movable contact and the fixed contact are separated by electromagnetic repulsive force, and an arc is generated between the contacts and an arc gas is generated at the same time.

At this time, an arc gas discharge hole 13*a* is provided on a side surface of the single pole breaking unit 13 so that an arc gas due to arc is discharged to the outside, and the arc gas trips the opening/closing mechanism unit 11 while being discharged to the outside through the arc gas discharge hole 13*a*.

On the other hand, a pressure trip device 20 is provided on a side surface of the single pole breaking unit 13 and is provided on a side surface of the arc gas discharge hole 13*a*.

At this time, the pressure trip device 20 includes a shield 21 for storing an arc gas discharged to the outside, a barrier 23 that maintains each phase to phase insulation and is bent by an arc gas discharged through the arc gas discharge hole 13*a*, a shooter 25 that operates by an arc gas and operates the trip bar 11*b* of the opening/closing mechanism unit 11, and an elastic member 27 for returning the shooter 25 to its original position after the pressure disappears.

Therefore, when a fault current flows in the circuit breaker 10, a current limiting operation is performed in which each contact is separated by electromagnetic repulsive force between the movable contact and the fixed contact, and at this time, an arc is generated between each contact, so that the internal pressure becomes large.

At this time, when the gas pressure of an arc gas due to arc is increased, the barrier 23 is bent to expose the arc gas discharge hole 13*a*, and the shooter 25 is pushed upward through the arc gas discharged through the arc gas discharge hole 13*a* and drives the trip bar 11*b* to trip the opening/closing mechanism unit 11.

However, the circuit breaker 10 including the pressure trip device 20 of the above structure is required to couple the shield 21, the barrier 23, and the shooter 25 to the case of the single pole breaking unit 13. Therefore, the assemblability is remarkably lowered, and there is a great risk that some component parts are omitted at the time of assembly.

In addition, when the single pole breaking unit 13 of each phase is coupled in the three-phase circuit breaker 10, during an operation of the pressure trip device 20 by the flow of fault current, each space between the single pole breaking units 13 is opened by the gas pressure of an arc gas. Therefore, there is a great risk that the arc gas G is discharged to the outside.

Further, when the arc gas is discharged to the outside, the amount of arc gas applied to the shooter 25 is greatly reduced, so that the shooter 25 does not move enough to drive the trip bar 11*b*.

In addition, when the fault current flows and the pressure trip device 20 operates, as each space between the single pole breaking units 13 is opened, the internal dust is also discharged together when the arc gas is discharged between each space of the single pole breaking units 13. Therefore, there is a problem that the withstand voltage performance is greatly lowered.

SUMMARY OF THE INVENTION

Therefore, an aspect of the detailed description is to provide a circuit breaker for configuring a pressure trip device, which is included in a single pole breaking unit, in a module form to improve the assemblability of the single pole breaking unit and the reliability of operations.

To achieve these and other advantages and in accordance with the purpose of this specification, as embodied and broadly described herein, there is provided a circuit breaker including a single pole breaking unit with a pressure trip device that rotates a trip bar through an arc gas and an opening/closing mechanism unit adjusted to be in a trip state as the trip bar rotates through the pressure trip device, wherein the pressure trip device includes: a first case connected to the single pole breaking unit and having an arc gas discharge hole; a barrier positioned in the front of the arc gas discharge hole and bent through an arc gas discharged through the arc gas discharge hole; a shooter seated on the first case and configured to drive the trip bar while moving through the arc gas discharged through the arc gas discharge hole; and a second case connected to cover the first case.

The shooter may not be positioned on the same line in a vertical direction as the arc gas discharge hole.

The shooter may include: an arc gas action portion disposed above the arc gas discharge hole; and a shooter portion configured to rotate the trip bar while moving up and down in connection to a side surface of the arc gas action portion.

An arc gas action groove may be formed on a lower surface of the arc gas action portion to allow an arc gas to collide with the arc gas action groove.

The arc gas action groove may be formed inclined as it progressively goes toward a center portion from both sides.

The arc gas action groove may be in a semicircular shape or a quadrangular shape.

A guide groove for guiding the arc gas action portion to move up and down through an arc gas may be formed on a side surface of the arc gas action portion; and a guide portion inserted into the guide groove to allow the arc gas action portion to move up and down may be formed on the first case.

An elastic member insertion portion allowing one end of an elastic member to be inserted thereto may be formed on an upper surface of the arc gas action portion.

A first inclined portion configured to limit a movement of the shooter portion may be formed on the first case; and a second inclined portion formed inclined to correspond to the first inclined portion and contacting the first inclined portion to limit a movement of the shooter portion when the shooter portion moves upward may be formed on the shooter portion.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Hereinafter, a circuit breaker according to an embodiment of the present invention will be described in detail with reference to the accompanying drawings.

Figure 1:
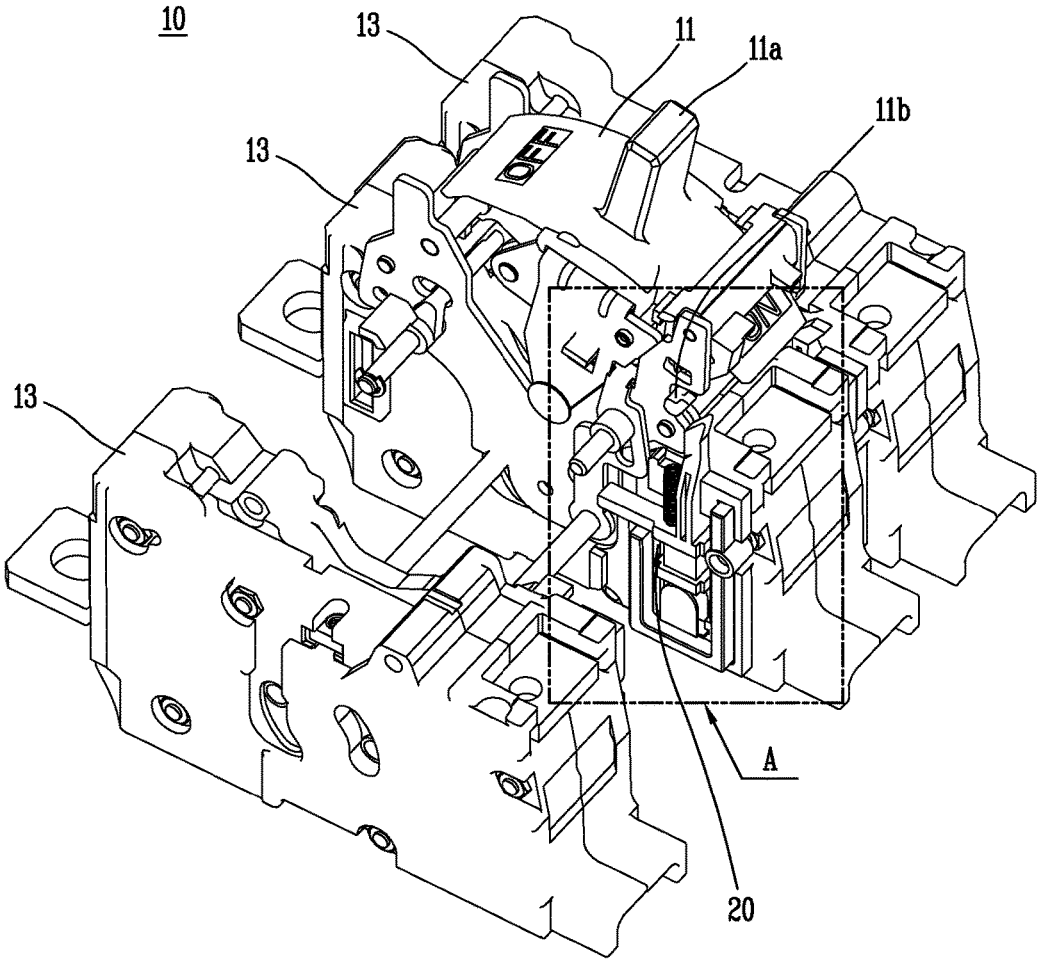
FIG. 1 RELATED ART
FIG. 1 is a perspective view showing a circuit breaker including a conventional single pole breaking unit.
Figure 2:
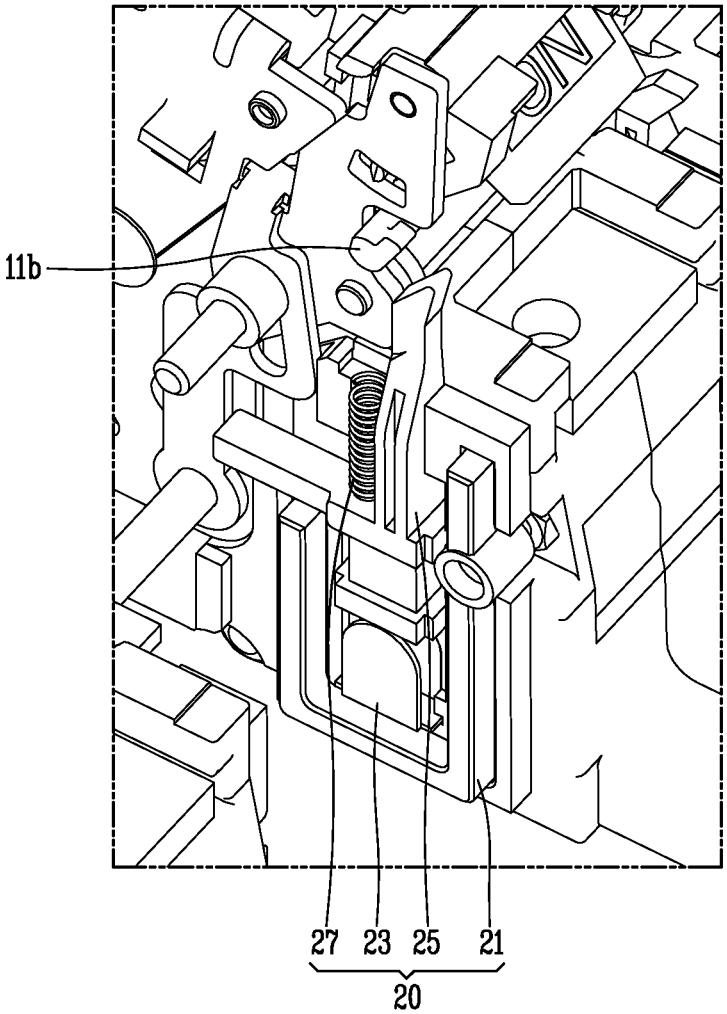
FIG. 2 RELATED ART
FIG. 2 is a partially enlarged view A of FIG. 1 showing a pressure trip device in a conventional single pole breaking unit.
Figure 3:
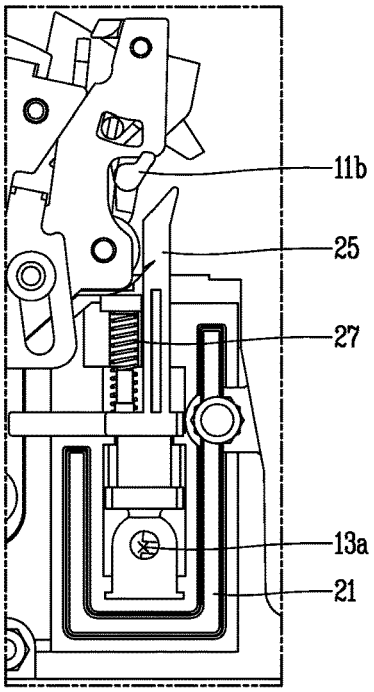
FIG. 3 RELATED ART
FIG. 3 is a side view showing an exhaust hole of a pressure trip device in a conventional single pole breaking unit.
Figure 4:
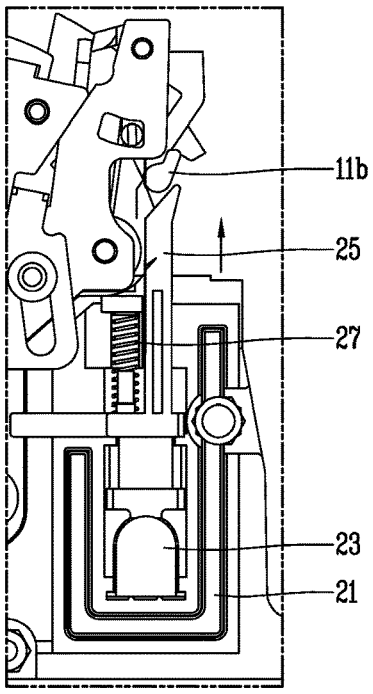
FIG. 4 RELATED ART
FIG. 4 is a side view showing a state before a shooter moves upward through a pressure trip device in a conventional single pole breaking unit.
Figure 5:
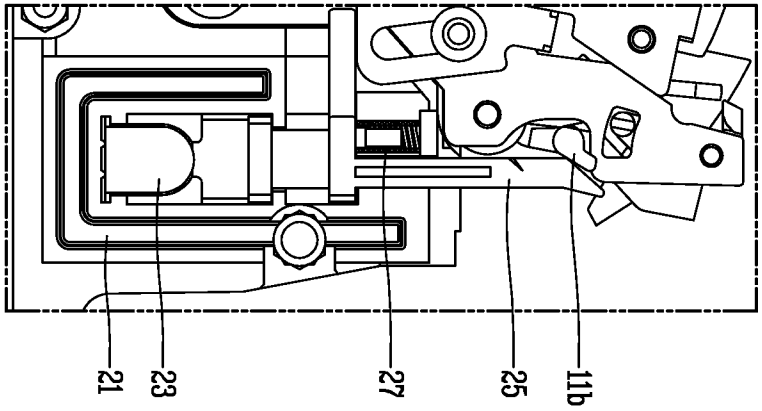
FIG. 5 RELATED ART
FIG. 5 is a side view showing a state in which a shooter moves upward through a pressure trip device in a conventional single pole breaking unit to move a trip bar.
Figure 6:
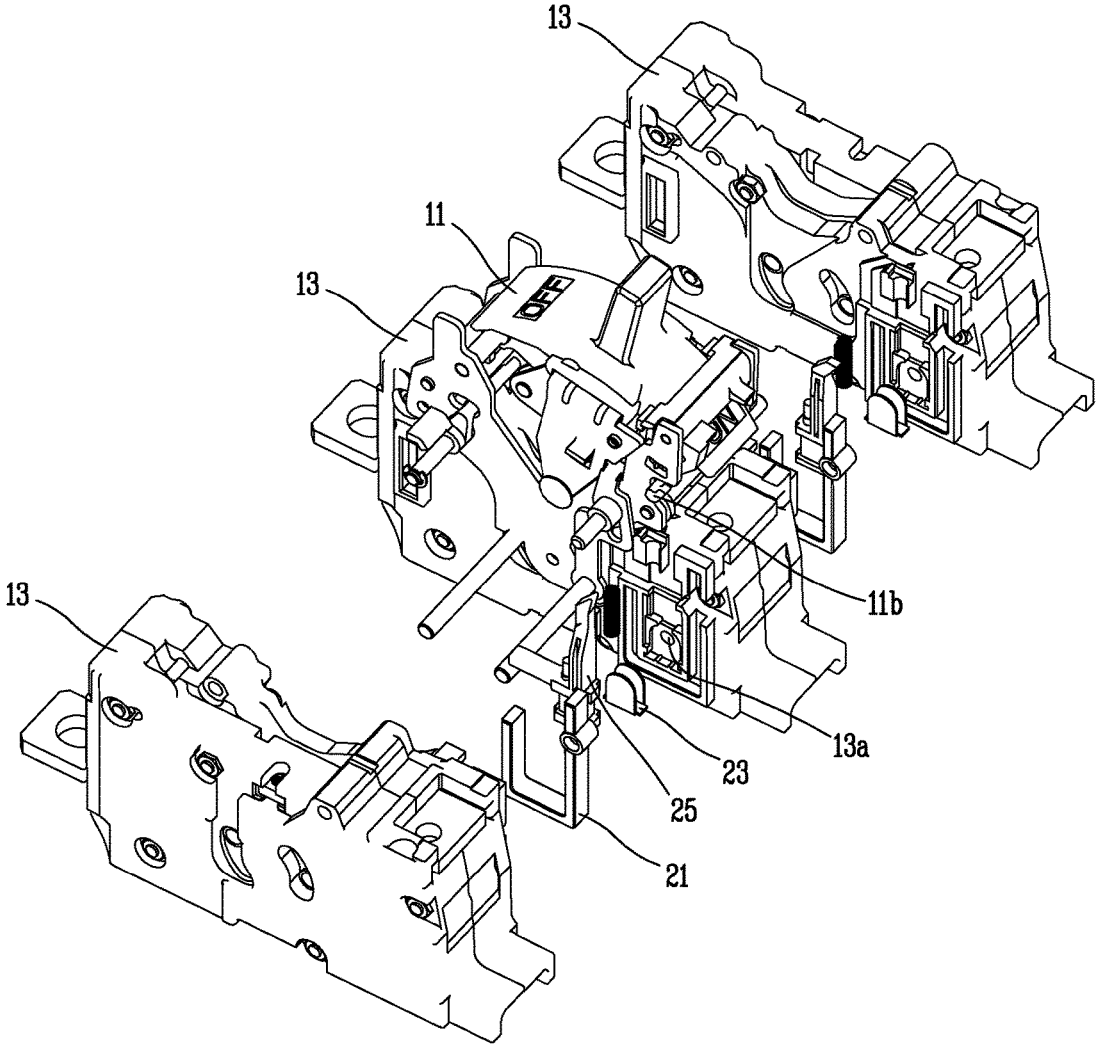
FIG. 6 RELATED ART
FIG. 6 is a perspective view showing a state in which a single pole breaking unit is separated from a conventional three-phase circuit breaker.
Figure 7:
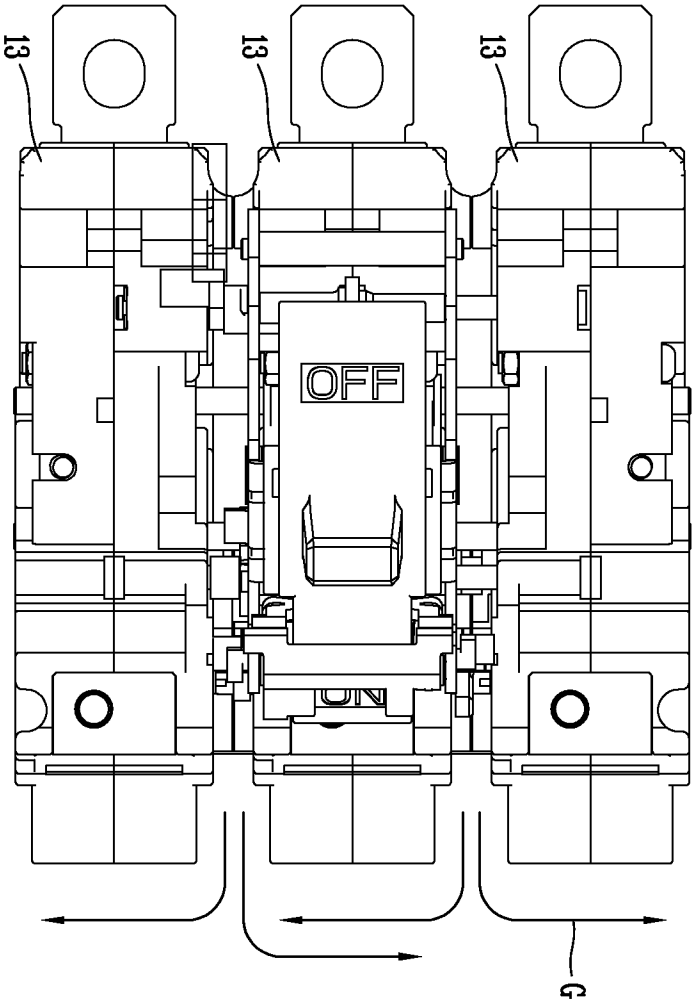
FIG. 7 RELATED ART
FIG. 7 is a plan view showing a state in which a single pole breaking unit is coupled to a conventional three-phase circuit breaker.
Figure 8:
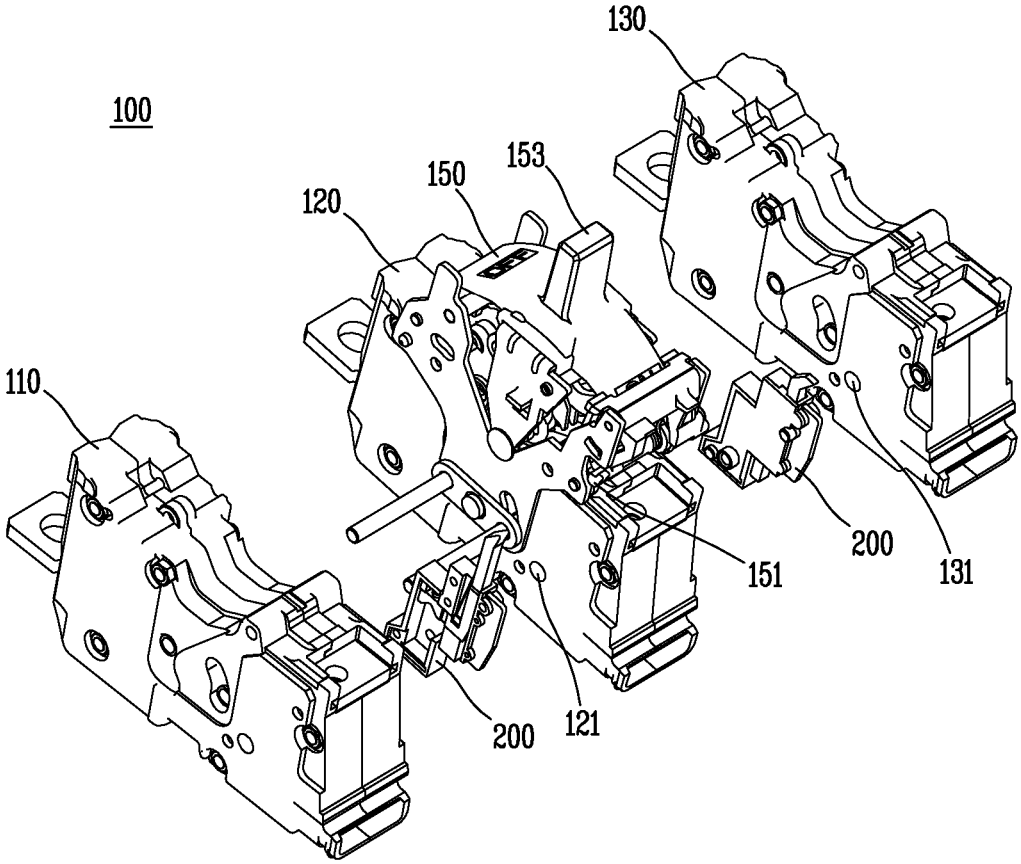
FIG. 8 is a perspective view showing a three-phase circuit breaker including a single pole breaking unit according to the present invention.
Figure 9:
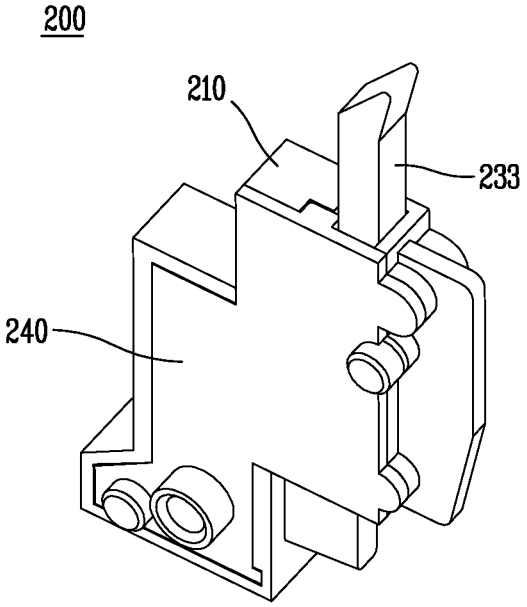
FIG. 9 is a perspective view showing a pressure trip device of a single pole breaking unit provided in a three-phase circuit breaker according to the present invention.
Figure 10:
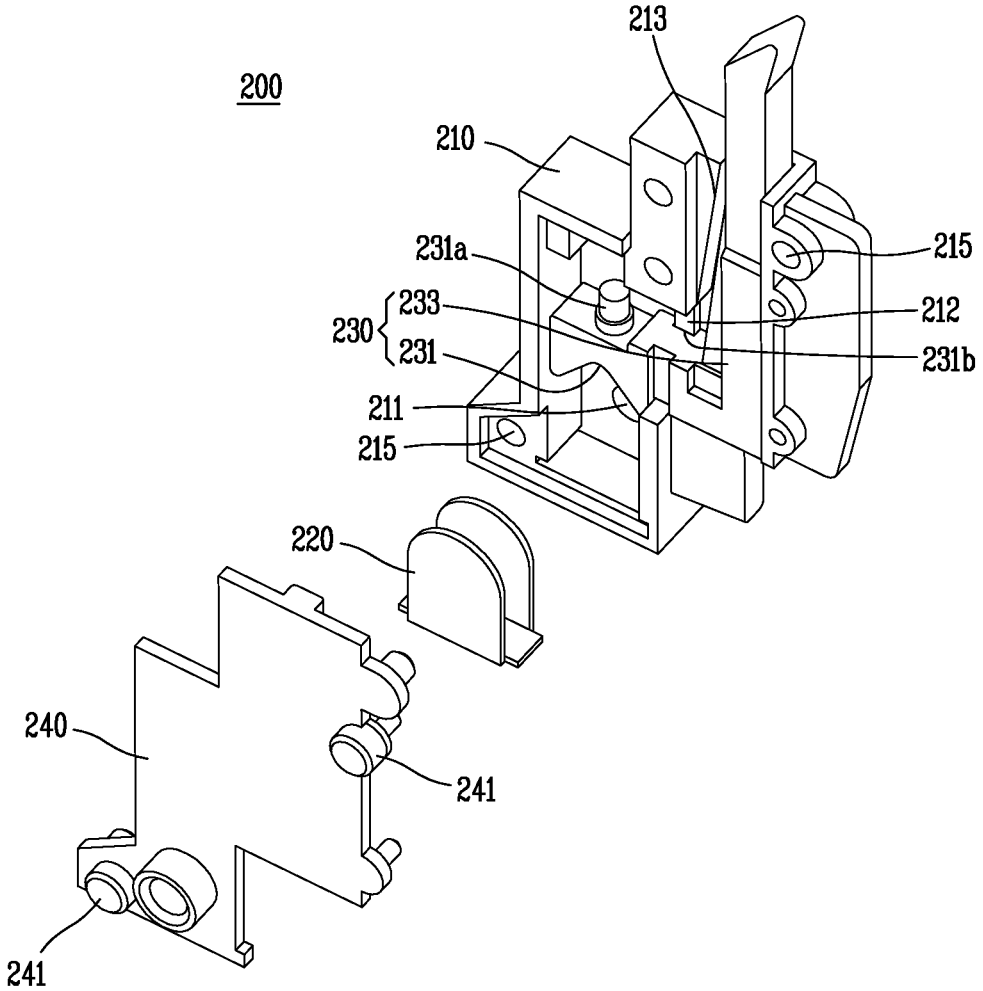
FIG. 10 is an exploded perspective view showing a state in which an elastic member is removed from a pressure trip device of a single pole breaking unit provided in a three-phase circuit breaker according to the present invention.
Figure 11:
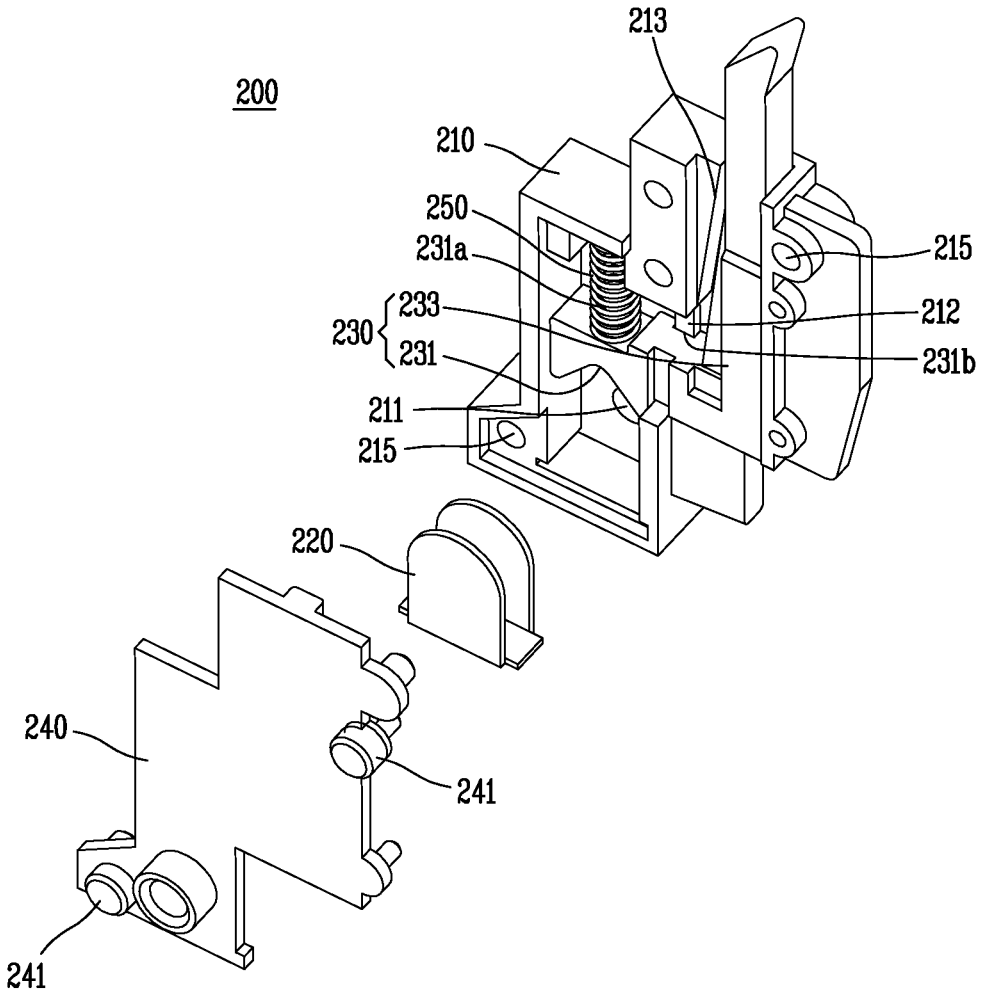
FIG. 11 is an exploded perspective view showing a state in which an elastic member is provided in a pressure trip device of a single pole breaking unit provided in a three-phase circuit breaker according to the present invention.

FIG. 8 is a perspective view showing a three-phase circuit breaker including a single pole breaking unit according to the present invention. FIG. 9 is a perspective view showing a pressure trip device of a single pole breaking unit provided in a three-phase circuit breaker according to the present invention. FIG. 10 is an exploded perspective view showing a state in which an elastic member is removed from a pressure trip device of a single pole breaking unit provided in a three-phase circuit breaker according to the present invention. FIG. 11 is an exploded perspective view showing a state in which an elastic member is provided in a pressure trip device of a single pole breaking unit provided in a three-phase circuit breaker according to the present invention.

Figure 12:
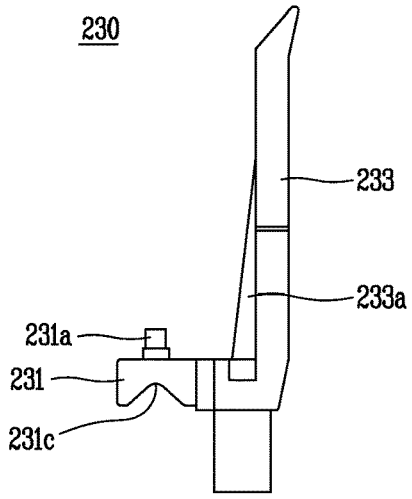
FIG. 12 is a front view showing a shooter in a pressure trip device of a single pole breaking unit provided in a three-phase circuit breaker according to the present invention.
Figure 13:
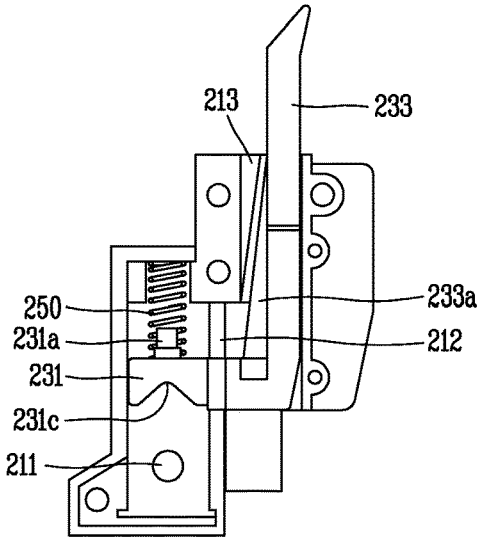
FIG. 13 is a front view showing a state before a shooter moves in a pressure trip device of a single pole breaking unit provided in a three-phase circuit breaker according to the present invention.
Figure 14:
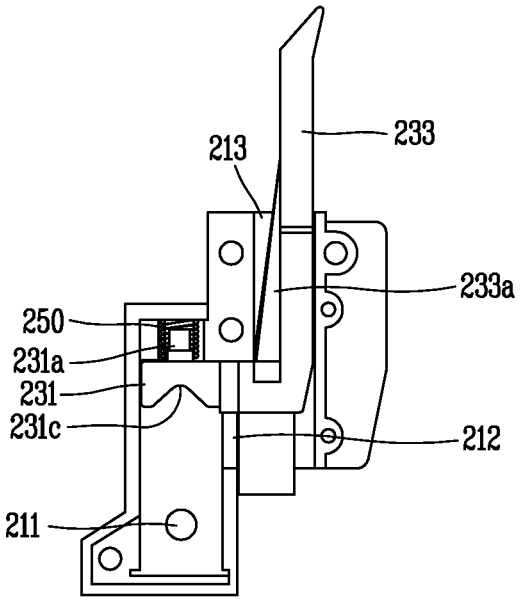
FIG. 14 is a front view showing a state in which a shooter moves upward through an arc gas in a pressure trip device of a single pole breaking unit provided in a three-phase circuit breaker according to the present invention.

In addition, FIG. 12 is a front view showing a shooter in a pressure trip device of a single pole breaking unit provided in a three-phase circuit breaker according to the present invention. FIG. 13 is a front view showing a state before a shooter moves in a pressure trip device of a single pole breaking unit provided in a three-phase circuit breaker according to the present invention. FIG. 14 is a front view showing a state in which a shooter moves upward through an arc gas in a pressure trip device of a single pole breaking unit provided in a three-phase circuit breaker according to the present invention.

As shown in FIG. 8, the circuit breaker 100 according to the present invention includes an opening/closing mechanism unit 150 and single pole breaking units 110, 120, and 130.

The opening/closing mechanism unit 150 is connected to be interlocked with a movable contact (not shown) provided in the single pole breaking units 110, 120, and 130 through a plurality of links (not shown) and the movable contact contacts or is separated from the fixed contact (not shown)

according to the rotation of the handle 153 so that the circuit breaker 100 is adjusted to be in the ON or OFF state.

When arc current is generated as the movable contact and the fixed contact are separated by the current limiting action with the application of a fault current, the single pole breaking units 110, 120, and 130 drive the trip bar 151 provided in the opening/closing mechanism unit 150 using an arc gas by arc to cause the opening/closing mechanism unit 150 to trip.

More specifically described, a module type pressure trip device 200 is coupled to the side surfaces of the single pole breaking units 110, 120, and 130, and a movable contact, a fixed contact, and an extinction unit (not shown) are provided in the single pole breaking units 110, 120 and 130.

Therefore, when a fault current is applied to the circuit breaker 100, the movable contact and the fixed contact are separated by the electromagnetic repulsive force, and an arc is generated between the contacts and an arc gas is generated at the same time.

At this time, discharge holes 121 and 131 are provided on the side surfaces of the single pole breaking units 110, 120, and 130 so that an arc gas due to arc is discharged to the outside. As being discharged to the pressure trip device 200 through the discharge holes 121 and 131, the arc gas moves the shooter 230 upward, which is provided in the pressure trip device 200, to drive the trip bar 151, thereby tripping the opening/closing mechanism unit 150.

The pressure trip device 200 is configured in a module form and connected to the side surfaces of the single pole breaking units 110, 120 and 130 through a plurality of coupling members (not shown), and when the arc gas is discharged from the single pole breaking units 110, 120, and 130, drives the trip bar 151 through the shooter 230, thereby adjusting the opening/closing mechanism unit 150 to be in a trip state.

On the other hand, as shown in FIGS. 9 to 11, the pressure trip device 200 includes a first case 210, a barrier 220, a shooter 230, a second case 240, and an elastic member 250.

The first case 210 forms an outer shape of the pressure trip device 200 and at least one fastening hole 215 is formed so that a fastening member (not shown) such as a bolt penetrates the fastening hole 215 and is connected to the side surfaces of the single pole breaking units 110, 120, and 130.

Further, in order to discharge the arc gas generated inside the single pole breaking units 110, 120, and 130, an arc gas discharge hole 211 is formed to correspond to the discharge holes 121 and 131.

The barrier 220 is positioned in front of the arc gas discharge hole 211 and is bent through an arc gas discharged through the arc gas discharge hole 211 to open or close the arc gas discharge hole 211.

The shooter 230 is seated at the first case 210 and drives the trip bar 151 while moving up and down through the arc gas discharged through the arc gas discharge hole 211.

At this time, in the conventional case, the shooter 230 is positioned on the same perpendicular line as the arc gas discharge hole 211. However, in the case of the present invention, by preventing the shooters 230 from being positioned on the same perpendicular line as the arc gas discharge holes 211, the discharge holes 121 and 131 may be configured at positions where a large amount of arc gas is generated, and by adjusting the shooter 230 to be positioned on the same perpendicular line as the trip bar 151 to a certain degree, the internal space of the circuit breaker 100 may be efficiently utilized.

The second case 240 is connected to the first case 210 in order to prevent each component in the pressure trip device 200 from being exposed to the outside, and one or more fastening holes 241 are formed so that a fastening member (not shown) such as a bolt penetrates the fastening hole 241 to be fixedly coupled to the first case 210.

On the other hand, as shown in FIG. 12, the shooter 230 includes an arc gas action portion 231 and a shooter portion 233.

The arc gas action portion 231 is positioned above the arc gas discharge hole 211. When an arc gas is discharged through the arc gas discharge hole 211, as the arc gas action portion 231 moves upward through the gas pressure of the arc gas, it moves the shooter portion 233 upward.

The shooter portion 233 is integrally connected to the side surface of the arc gas action portion 231 and moves upward in linkage with the arc gas action portion 231 to drive the trip bar 151.

At this time, an arc gas action groove 231*c* is formed on the lower surface of the arc gas action portion 231 so as to allow the arc gas to collide with it. The arc gas action groove 231*c* is formed to be inclined inward as it progressively goes toward the central portion from both sides.

Accordingly, when the arc gas is discharged through the arc gas discharge hole 211 and collides with the arc gas action groove 231*c*, the gas pressure is effectively delivered to the arc gas action portion 231.

At this time, the arc gas action groove 231*c* may be formed in a semicircular shape or a quadrangular shape, but the shape of the arc gas action groove 231*c* is not limited thereto. That is, the arc gas action groove 231*c* may be formed in various shapes that effectively transmit the gas pressure of an arc gas to the arc gas action portion 231.

Meanwhile, a guide groove 231*b* for guiding the arc gas action portion 231 to move up and down through the arc gas is formed on the side surface of the arc gas action portion 231, and a guide portion 212 inserted into the guide groove 231*b* to guide the arc gas action portion 231 to move up and down is formed on the inner side surface of the first case 210.

Therefore, the arc gas action portion 231 may move up and down through the arc gas without shaking from side to side in a state where the arc gas action portion 231 is inserted into the guide portion 212 through the guide groove 231*b*.

The elastic member 250 is formed of a spring and is positioned between the first case 210 and the arc gas action portion 231. When the arc gas action portion 231 moves upward through the arc gas, the elastic member 250 is compressed. When the arc gas is removed, a restoring force is provided to the arc gas action portion 231 so that the shooter 230 returns to its original position.

At this time, an elastic member insertion portion 231*a* is formed protruding from the upper surface of the arc gas action portion 231. In a state where one end of the elastic member 250 is inserted into the elastic member insertion portion 231*a* and the other end contacts the inner side surface of the first case 210, the elastic member 250 is positioned between the arc gas action portions 231 and fixedly supported.

A first inclined portion 213 may be formed in the first case 210 to restrict the movement of the shooter portion 233 and a second inclined portion 233*a* may be formed in the shooter portion 233.

The first inclined portion 213 is positioned adjacent to the shooter portion 233 so that when the shooter portion 233 moves upward through the arc gas, it contacts the second inclined portion 233*a* and limits the movement of the shooter portion 233 to an appropriate position.

The second inclined portion 233*a* may be inclined to correspond to the first inclined portion 213 so that when the shooter portion 233 moves upward, it contacts the first inclined portion 213 and limits the movement of the shooter portion 233.

Thus, by forming the first inclined portion 213 and the second inclined portion 233*a* in the first case 210 and the shooter portion 233, the movement position of the shooter portion 233 is appropriately limited through a simpler structure, and the collision between the first case 210 and the shooter portion 233 is prevented.

Hereinafter, a process of tripping the opening/closing mechanism unit 150 through the pressure trip device 200 provided in the circuit breaker 100 according to the present invention will be described in detail with reference to FIG. 13 and FIG. 14.

First, as shown in FIG. 13, when a fault current is applied, an arc is generated while a movable contact and a stationary contact are separated through a current limiting action and an arc gas is generated at the same time. The arc gas is discharged through the discharge holes 121 and 131 provided in the single pole breaking units 110, 120, and 130.

The arc gas discharged through the discharge holes 121 and 131 moves into the pressure trip device 200 through the arc gas discharge hole 211 formed in the first case 210 to push the arc gas action portion 231 upward.

At this time, the elastic member 250 positioned between the arc gas action portion 231 and the first case 210 is compressed through the arc gas action portion 231.

Further, as shown in FIG. 14, when the arc gas action portion 231 moves upward through the arc gas, as the shooter portion 233 integrally connected to the side surface of the arc gas action portion 231 also moves upward in linkage with the arc gas action portion 231, one end of the shooter portion 233 pushes the trip bar 151 to adjust the opening/closing mechanism unit 150 to be in a trip state.

After the arc gas is removed, the arc gas action portion 231 is returned to its original position by receiving the restoring force of the elastic member 250, and the shooter portion 233 connected to the arc gas action portion 231 also moves downward together with the arc gas action portion 231 to release the trip state of the opening/closing mechanism unit 150.

In the case of the present invention configured to operate as described above, the pressure trip device 200 provided in the single pole breaking units 110, 120 and 130 is configured in a module form using the first case 210, the shooter 230, the second case 240 so as to allow it to be easily detachable from the single pole breaking units 110, 120 and 130 through a fastening member, thereby improving the assemblability of the pressure trip device 200.

Also, by allowing the pressure trip device 200 to be configured in a module form using the first case 210, the shooter 230, and the second case 240, in the case that a plurality of single pole breaking units 110, 120, 130 are used such as the three-phase circuit breaker 100, even when adjacent single pole breaking units 110, 120, and 130 are opened to both sides, the arc gas is prevented from being discharged to the outside.

In addition, by preventing the arc gas discharge hole 211 and the shooter 230 from being positioned on the same vertical line, the position of the arc gas discharge hole 211 or the shooter 230 is not limited, thereby fully utilizing the internal space of the circuit breaker 100.

Further, since the pressure trip device 200 is configured in a module form to prevent the discharge of the arc gas, dust discharged along with the arc gas may be prevented from being externally discharged, thereby preventing deterioration of the withstand voltage performance of the circuit breaker 100 due to dust exhaustion.

Further, by forming the arc gas action groove 231*c* on the lower surface of the arc gas action portion 231 and forming the arc gas action groove 231*c* to be inclined inward, the gas pressure of the arc gas discharged through the arc gas discharge hole 211 is effectively transmitted to the shooter 230 through the arc gas action groove 231*c*.

By forming the guide portion 212 on the inner side surface of the first case 210 and forming the guide groove 231*b* in the arc gas action portion 231, when the arc gas action portion 231 moves up and down through the arc gas, it is prevented from shaking from side to side.

Furthermore, the first inclined portion 213 is formed in the first case 210 and the second inclined portion 233*a* is formed in the shooter portion 233 so that the first inclined portion 213 and the second inclined portions 233*a* contact each other when the shooter portion 233 moves. Therefore, it is possible to prevent damage due to the collision of the shooter portion 233 with the first case 210 through a simple structure and adequately limit the movement of the shooter portion 233 at the same time.

As described above, in relation to the circuit breaker of the present invention, a pressure trip device provided in a single pole breaking unit is configured in a module form using a first case, a shooter, a second case so as to allow it to be easily detachable from the single pole breaking unit, thereby improving the assemblability of the pressure trip device.

Also, by allowing the pressure trip device to be configured in a module form using the first case, the shooter, and the second case, in the case that a plurality of single pole breaking units are used such as a three-phase circuit breaker, even when adjacent single pole breaking units are opened to both sides, an arc gas is prevented from being discharged to the outside.

In addition, by preventing an arc gas discharge hole and a shooter from being positioned on the same vertical line, the position of the arc gas discharge hole or the shooter is not limited, thereby fully utilizing the internal space.

Further, since the pressure trip device is configured in a module form to prevent the discharge of the arc gas, dust discharged along with the arc gas may be prevented from being externally discharged, thereby preventing deterioration of the withstand voltage performance of the circuit breaker due to dust exhaustion.

Moreover, by forming an arc gas action groove on the lower surface of an arc gas action portion and forming an arc gas action groove to be inclined inward, the gas pressure of the arc gas discharged through the arc gas discharge hole is effectively transmitted to the shooter through the arc gas action groove.

Additionally, by forming a guide portion on the first case and forming a guide groove on the arc gas action portion, when the arc gas action portion moves up and down through the arc gas, it is prevented from shaking from side to side.

Furthermore, a first inclined portion is formed in the first case and a second inclined portion 233*a* is formed in the shooter portion so that the first inclined portion and the second inclined portions contact each other when the shooter moves. Therefore, it is possible to prevent damage due to the collision of the shooter portion with the first case through a simple structure and adequately limit the movement of the shooter portion at the same time.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A circuit breaker comprising a single pole breaking unit with a pressure trip device that rotates a trip bar through an arc gas and an opening/closing mechanism unit adjusted to be in a trip state as the trip bar rotates through the pressure trip device, wherein the pressure trip device comprises:

a first case connected to the single pole breaking unit and having an arc gas discharge hole;

a barrier positioned in the front of the arc gas discharge hole and bent through an arc gas discharged through the arc gas discharge hole;

a shooter seated on the first case and configured to drive the trip bar while moving through the arc gas discharged through the arc gas discharge hole; and a second case connected to cover the first case, wherein the shooter comprises:

an arc gas action portion disposed above the arc gas discharge hole; and a shooter portion configured to rotate the trip bar while moving up and down in connection to a side surface of the arc gas action portion, and wherein the shooter portion defines a vertical line, and the arc gas discharge hole is not positioned on the vertical line defined by the shooter portion.

2. The circuit breaker of claim 1, wherein an arc gas action groove is formed on a lower surface of the arc gas action portion to allow an arc gas to collide with the arc gas action groove.

3. The circuit breaker of claim 2, wherein the arc gas action groove is formed inclined as it progressively goes toward a center portion from both sides.

4. The circuit breaker of claim 2, wherein the arc gas action groove is in a semicircular shape or a quadrangular shape.

5. The circuit breaker of claim 1, wherein:

a guide groove for guiding the arc gas action portion to move up and down through an arc gas is formed on a side surface of the arc gas action portion; and a guide portion inserted into the guide groove to allow the arc gas action portion to move up and down is formed on the first case.

6. The circuit breaker of claim 5, wherein an elastic member insertion portion allowing one end of an elastic member to be inserted thereto is formed on an upper surface of the arc gas action portion.

7. The circuit breaker of claim 1, wherein:

a first inclined portion configured to limit a movement of the shooter portion is formed on the first case; and a second inclined portion formed inclined to correspond to the first inclined portion and contacting the first inclined portion to limit a movement of the shooter portion when the shooter portion moves upward is formed on the shooter portion.

* * * * *